US008747175B1

(12) United States Patent
Frenna

(10) Patent No.: US 8,747,175 B1
(45) Date of Patent: Jun. 10, 2014

(54) ERGONOMIC FLOTATION DEVICE

(71) Applicant: Jodi Frenna, Redding, CA (US)

(72) Inventor: Jodi Frenna, Redding, CA (US)

( * ) Notice: Subject to any disclaimer, the term of this patent is extended or adjusted under 35 U.S.C. 154(b) by 0 days.

(21) Appl. No.: 13/649,389

(22) Filed: Oct. 11, 2012

(51) Int. Cl.
*B63C 9/08* (2006.01)

(52) U.S. Cl.
USPC ..... 441/129

(58) Field of Classification Search
USPC ..... 441/129, 135
See application file for complete search history.

(56) References Cited

U.S. PATENT DOCUMENTS 4,693,691 A * 9/1987 DeYoe ..... 441/129
4,872,229 A 10/1989 Brady
4,872,299 A * 10/1989 Troutner et al. ..... 52/693
5,049,102 A * 9/1991 Hull ..... 441/41
D351,526 S * 10/1994 Tarquinio ..... D6/604
6,142,844 A * 11/2000 Klauber ..... 441/129
7,699,017 B1 * 4/2010 Marshall ..... 114/315
7,818,842 B2 * 10/2010 Marciano ..... 5/694
7,927,164 B2 * 4/2011 Kuchler ..... 441/135

* cited by examiner

*Primary Examiner* — Lars A Olson
*Assistant Examiner* — Jovon Hayes

(57) ABSTRACT

The invention is a unique ergonomic personal flotation device suitable for comfortably supporting a human user while floating in a fairly calm water-based environment such as a swimming pool, lake or other natural body of water that allows a person using the flotation device to comfortably lie on their stomach, in order to provide even tanning on their backside. Likewise, the person can also comfortably lie on their back to get tanning on the front of their body. The ergonomic flotation device is comprised of a number of separate air chambers that provide an overall comfortable ergonomic experience when in use by a person. When lying on their stomach, there is provided an opening for the person's face with side air channels around the opening for comfort. When lying on their back, there is provided a separately inflatable lower back support chamber.

4 Claims, 2 Drawing Sheets

ERGONOMIC FLOTATION DEVICE

CROSS-REFERENCE TO RELATED APPLICATIONS

N/A

STATEMENT REGARDING FEDERALLY SPONSORED RESEARCH

N/A

THE NAMES OF THE PARTIES TO A JOINT RESEARCH AGREEMENT

N/A

INCORPORATION-BY-REFERENCE OF MATERIAL SUBMITTED ON A COMPACT DISC

N/A

BACKGROUND OF THE INVENTION (1) Field of the Invention

The field of the invention is that of individual consumer flotation devices for home and resort use. In particular, the field for a device which is an ergonomically designed inflatable raft with unique features.

(2) Description of Related Art Including Information Disclosed Under 37 CFR 1.97 and 1.98

Utility U.S. Pat. No. 4,872,229, Date of Patent: Oct. 10, 1989, discloses a waterproof inflatable massage air mattress having an inflatable head cushion portion that is spaced a predetermined distance from its inflatable body cushion portion. In the space there between is formed a vibrator cushion portion. The vibrator cushion portion has a chamber closed at its rear end and its front end is opened and closed by a water impermeable linear seal. A vibrator assembly is removably received within the chamber and it is formed from a tubular foam core within which is positioned a vibrator unit. The vibrator unit has a vibrator motor and batteries that are electrically connected together and also connected to a button switch that is mounted in the rear end wall of the tubular foam core. A primary flap and a secondary flap provide protective cover for the water impermeable linear seal.

Utility U.S. Pat. No. 7,818,842, Date of Patent: Oct. 26, 2010, discloses a foldable mattress having an integral carrying pouch into which the mattress may be folded when not in use. Preferably, the mattress is at least partly inflatable so as to be floatable, and may have a mesh central portion surrounded by an inflatable portion. An inflatable pillow or headrest that is either fixed in place or detachable may be included. The pouch itself is preferably made, at least in part, of nylon mesh material.

Utility U.S. Pat. No. 5,049,102, Date of Patent: Sep. 17, 1991, discloses a recreational raft apparatus which comprises an inflatable, floatable body portion, and at least one closable pocket in association with the body portion of the raft. The raft may further comprise an inflatable pillow which is attached to the body portion, as well as handles attached to the body portion of the raft for carrying the raft. A towel may be attached to the top side of the raft by clips.

BRIEF SUMMARY OF THE INVENTION

The invention is a unique personal flotation device that allows a person using the flotation device to comfortably lie on their stomach, in order to provide even tanning on their backside. Likewise, the person can also comfortably lie on their back to get tanning on the front of their body. The ergonomic flotation lounge is comprised of a number of separate air chambers that provide an overall comfortable ergonomic experience when in use by a person.

DETAILED DESCRIPTION OF THE INVENTION

Reference Numerals

Figure 1:
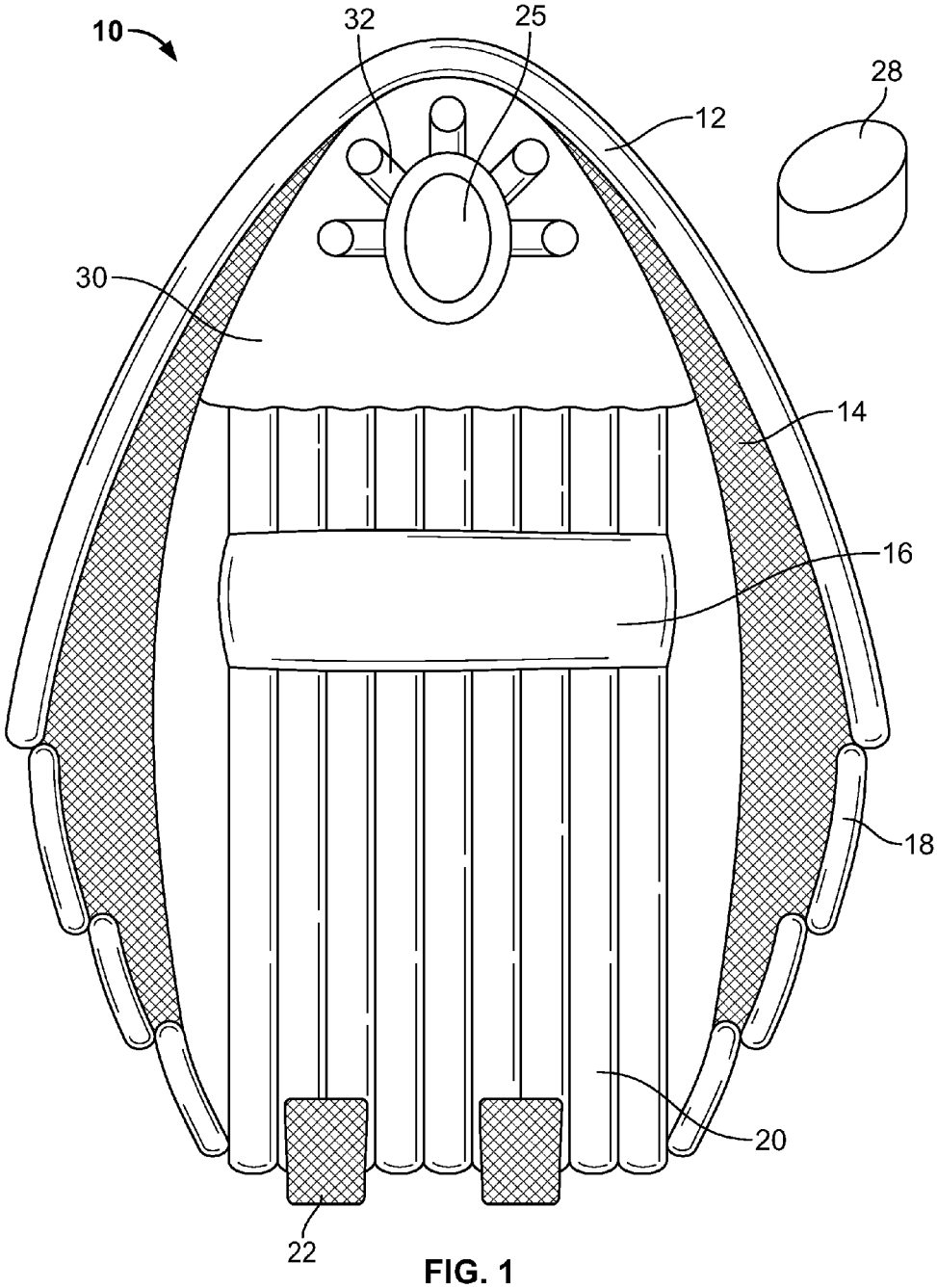
FIG. 1—shows a simple version of the invention with all the ergonomic features FIG. 2—shows a more elaborate and decorative version of the invention with all the ergonomic features

10—flotation lounge is a unique personal flotation device that allows a person using the flotation device to comfortably lie on their stomach, in order to provide even tanning on their backside. Likewise, the person can also comfortably lie on their back to get tanning on the front of their body. The flotation lounge 10 is comprised of a number of separate air chambers that provide an overall ergonomic experience in use by a person.

12—inflated outer-tube is an air chamber that supports the flotation lounge 10 while in the water to provide stability and buoyancy in the water. The inflated outer tube is comprised of a durable non-porous material, such as plastic, that can retain compressed air, and allows the user to rest arms comfortably out of the water.

14—mesh arm rests are typically extra wide and provide for comfort of the person's arms while using the flotation lounge 10. The arm rests allow for arms to be by the user's side, or overhead. In the alternative, if the person wants to keep their arms dry, they can rest their arms on the inflated outer tube 12. In mesh format the material would be comprised of nylon or other sturdy porous mesh material allowing water to pass freely through the mesh interstices.

16—expandable mid-section is a separate air chamber comprised of a durable non-porous material, such as plastic, that can retain compressed air. This expandable mid-section 16 is attached underneath the floatation lounge 10, and can be separately expanded by infusing air to raise the top level of the expandable mid-section 16 so that the person, while lying on their stomach or on their back on the flotation lounge 10 will have proper support of the back and spine.

18—side-support chambers are located on each side of the flotation lounge 10 and below the mid-point of the flotation lounge 10. The side support chambers are inflated with air and provide extra stability and buoyancy in the water when the flotation lounge 10 is in use by a person.

20—central-support chambers are located for some embodiments in the center of the flotation lounge 10 and can also be on the top portion of the flotation lounge 10 above the expandable mid-section 16 and below the expandable mid-section 16.

22—foot tapered ends are mesh fabric tapered ends. These twin foot tapered ends 22 afford the person the opportunity to support their ankles with feet allowed to be in or out of the water, so that their legs are then level with their body, adding to the comfort of using the flotation lounge 10. The mesh fabric allows for cooling from the water, to the ankles and/or feet.

25—convertible face-opening is a oval-shaped opening in the shoulder support area 30 positioned toward the top of the shoulder support area 30 that has a sealed or mesh bottom portion such that water is not allowed into the convertible face opening 25 from below. Thus, a person can lie comfortably with their face positioned over and inside the convertible face opening 25 and still breathe comfortably while the flotation lounge is floating on the water. The convertible face opening 25 can be converted into a convenient head pillow by inflating an external head pillow 28 that is then inserted into the convertible face opening 25 chamber such that the person's head can then lie comfortably on the external head pillow 28 now protruding above the convertible face opening 25 and the level of the shoulder support area 30.

28—external head pillow is a separate inflatable oval shaped air chamber that can then be inserted into the convertible face opening 25 chamber such that the person's head can then lie comfortably on the external head pillow 28 now protruding above the convertible face opening 25 and the level of the shoulder support area 30.

30—shoulder-support area is a single smooth faced air-filled chamber roughly triangular in shape at the top of the central support chambers 20 and inside the inflated outer tube 12 that provides comfortable support for the person's shoulders while reclining on their back and support for their chest while reclining on their stomach.

32—air vents are openings dispersed around the convertible face opening 25 to allow the air to pass through openings inside the interior lining of the convertible face opening 25 to allow the person to breathe comfortably when their face is inserted into the convertible face opening 25.

DETAILED DESCRIPTION OF THE DRAWINGS

FIG. 1—is a top view that shows a simple version of the invention with all the ergonomic features of the flotation device 10, which is described as a flotation lounge 10 that allows a person using the flotation device 10 to comfortably lie on their stomach, in order to provide even tanning on their backside. Likewise, the person can also comfortably lie on their back to get tanning on the front of their body. The flotation lounge 10 is comprised of a number of separate air chambers 12, 20 that provide an overall ergonomic experience when in use by a person. When lying face down, the flotation device provides a convertible face-opening 25 that is an oval-shaped opening in the shoulder support area 30 positioned toward the top of the shoulder support area 30 that has a sealed or mesh bottom portion such that water is not allowed into the convertible face opening 25 from below. Dispersed around the interior lining of the convertible face opening 25 are air vents 32 which are openings to allow the air to pass through them to allow the person to breathe comfortably when their face is inserted into the convertible face opening 25. An external head pillow 28 is provided for the person lying on their back, and is a separate inflatable oval shaped air chamber that can then be inserted into the convertible face opening 25 chamber such that the person's head can then lie comfortably on the external head pillow 28 now protruding above the convertible face opening 25 and the level of the shoulder support area 30. Also shown is the expandable mid-section 16 which is a separate air chamber comprised of a durable non-porous material, such as plastic, that can retain compressed air. This expandable mid-section 16 is attached underneath the floatation lounge 10, and can be separately expanded by infusing air to raise the top level of the expandable mid-section 16 so that the person, while lying on their stomach or on their back on the flotation lounge 10 will have proper support of the back and spine. Also shown in this figure are the central-support chambers 20 which are located on the top portion of the flotation lounge 10 above the expandable mid-section 16 and below the expandable mid-section 16. The side-support chambers 18 are located on each side of the flotation lounge 10 and below the mid-point of the flotation lounge 10. The side-support chambers are inflated with air and provide extra stability and buoyancy in the water when the flotation lounge 10 is in use. For extra comfort, shown are the foot tapered ends 22, which are mesh fabric tapered ends. These twin foot tapered ends 22 afford the person the opportunity to support their ankles with feet allowed to be in or out of the water, so that their legs are then level with their body, adding to the comfort of using the flotation lounge 10. The mesh fabric allows for cooling from the water, to the ankles and/or feet. The mesh arm rests 14 are typically extra wide and provide for comfort of the person's arms while using the flotation lounge 10. The arm rests 14 allow for arms to be by the user's side, or overhead. In the alternative, if the person wants to keep their arms dry, they can rest their arms on the inflated outer tube 12.

Figure 2:
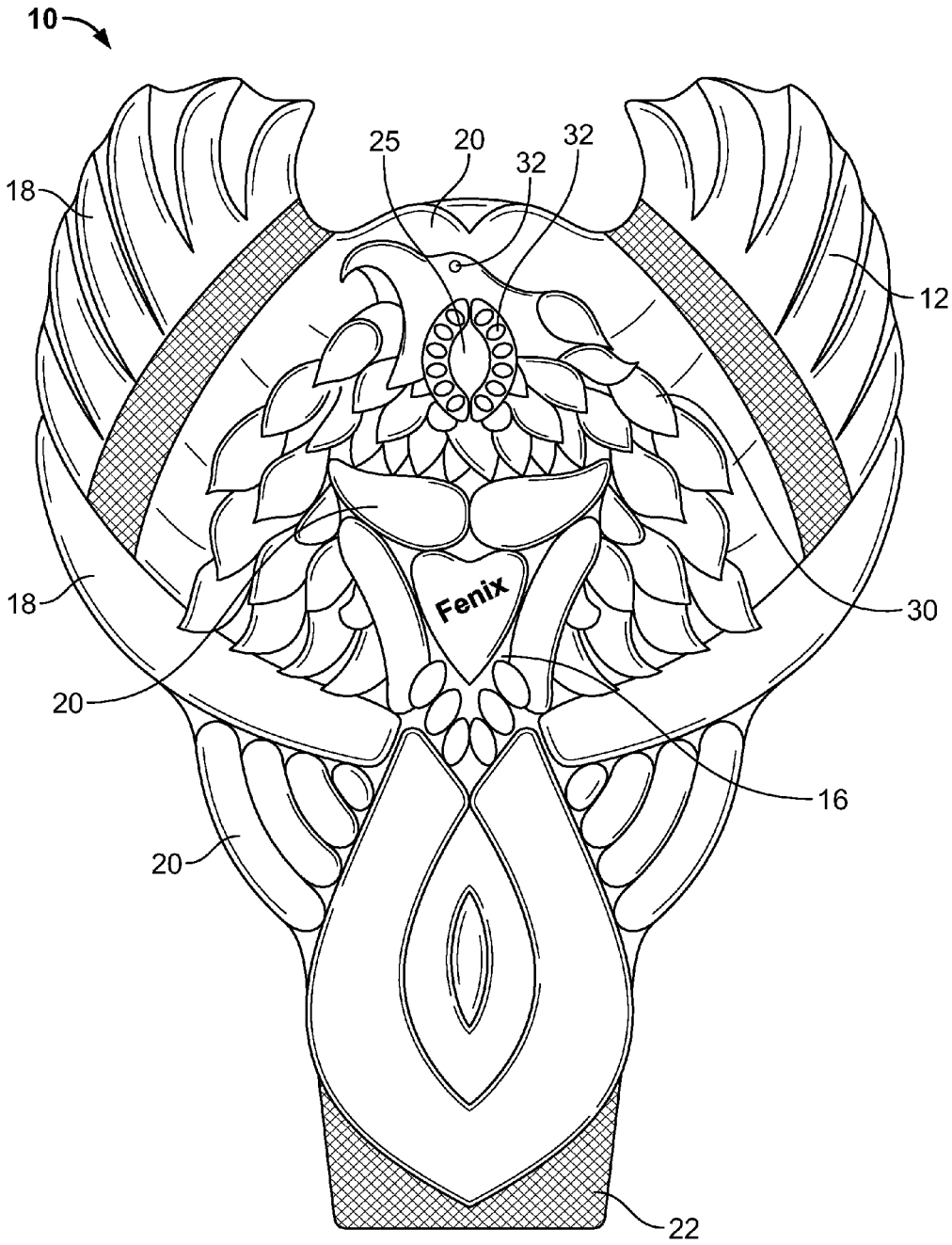

FIG. 2—shows a more elaborate and decorative version of the invention with all the ergonomic features of the flotation device 10, which is described as a flotation lounge 10 that allows a person using the flotation device 10 to comfortably lie on their stomach, in order to provide even tanning on their backside. Likewise, the person can also comfortably lie on their back to get tanning on the front of their body. The flotation lounge 10 is comprised of a number of separate air chambers 12, 20 that provide an overall ergonomic experience when in use by a person. When lying face down, the flotation device provides a convertible face-opening 25 that is an oval-shaped opening in the shoulder support area 30 positioned toward the top of the shoulder support area 30 that has a sealed or mesh bottom portion such that water is not allowed into the convertible face opening 25 from below. Dispersed around the interior lining of the convertible face opening 25 are air vents 32 which are openings to allow the air to pass through them to allow the person to breathe comfortably when their face is inserted into the convertible face opening 25. An external head pillow 28 (see FIG. 1) is provided for the person lying on their back, and is a separate inflatable oval shaped air chamber that can then be inserted into the convertible face opening 25 chamber such that the person's head can then lie comfortably on the external head pillow 28 now protruding above the convertible face opening 25 and the level of the shoulder support area 30. Also shown is the expandable mid-section 16 which is a separate air chamber comprised of a durable non-porous material, such as plastic, that can retain compressed air. This expandable mid-section 16 is attached underneath the floatation lounge 10, and can be separately expanded by infusing air to raise the top level of the expandable mid-section 16 so that the person, while lying on their stomach or on their back on the flotation lounge 10 will have proper support of the back and spine. Also shown in this figure are the central-support chambers 20 which are located on the top portion of the flotation lounge 10 above the expandable mid-section 16 and below the expandable mid-section 16. The side-support chambers 18 are located on each side of the flotation lounge 10 and below the mid-point of the flotation lounge 10. The side-support chambers are inflated with air and provide extra stability and buoyancy in the water when the flotation lounge 10 is in use. For extra comfort, shown are the foot tapered ends 22, which are mesh fabric tapered ends. These twin foot tapered ends 22 afford the person the opportunity to support their ankles with feet allowed to be in or out of the water, so that their legs are then level with their body, adding to the comfort of using the flotation lounge 10. The mesh fabric allows for cooling from the water, to the ankles and/or feet. Provided are inflated outer-tubes 12 which are air chambers that supports the flotation lounge 10 while in the water to provide stability and buoyancy in the water. The inflated outer tubes 12 allow the user to rest arms comfortably out of the water.

The invention claimed is:

1. An ergonomic flotation device suitable for comfortably supporting a human user while floating in a body of water comprised of:

at least one inflated outer chamber formed into an open-ended oval shape having a closed-end upper portion and having an open-ended lower portion, and said open-ended lower portion forming the outside edge of the upper portion of said ergonomic flotation device;

stretched mesh material suitable for resting a human user's arms is inside each said closed-end upper portion of said inflated outer chamber and affixed to the inner side of said closed-end upper portion of said inflated outer chamber;

an inflatable shoulder support area is located next to and affixed to the inside edge of the center of said upper portion of said inflated outer chamber and also located towards the top of said inflatable shoulder support area is an opening for a human user's face surrounded by multiple pre-formed air vents that allow the passage of air when a human user's face is inserted into said opening in said inflatable shoulder support area;

multiple centrally located inflatable chambers are located below said inflatable shoulder support area, the upper portion of said multiple centrally located inflatable chambers have affixed toward the top portion thereof a separately inflatable horizontal chamber for lower back support and overall spine support of a human user; and, located at the bottom portion of said multiple centrally located inflatable chambers are two tapered openings in said multiple centrally located inflatable chambers wherein is affixed in each said tapered opening, mesh material upon which a human user can rest his or her feet whether a human user is lying face down or face up on said ergonomic flotation device.

2. An ergonomic flotation device according to claim 1, wherein said opening for a human user's face in said inflatable shoulder support area has an inflatable pillow inserted for resting a human user's head while resting face up.

3. An ergonomic flotation device according to claim 1, wherein said inflatable shoulder support area has affixed toward the top portion thereof separately inflatable decorative inflatable chambers for lower back support of a human user.

4. An ergonomic flotation device according to claim 1, wherein said inflatable shoulder support area is comprised of decoratively arranged inflatable chambers.

* * * * *